United States Patent [19]

Beall

[11] Patent Number: 4,625,708

[45] Date of Patent: Dec. 2, 1986

[54] STOVE GUARD

[76] Inventor: Alvan H. Beall, Apt. #2, 6037 Majors La., Columbia, Md. 21045

[21] Appl. No.: 801,285

[22] Filed: Nov. 25, 1985

[51] Int. Cl.[4] ..... F24C 3/12

[52] U.S. Cl. ..... 126/42

[58] Field of Search ..... 126/42, 201, 202, 277, 126/278; 312/295; 160/DIG. 13, 352

[56] References Cited

U.S. PATENT DOCUMENTS

| | | | |
|---|---|---|---|
| 991,216 | 5/1911 | Lawrence | 126/42 |
| 1,076,465 | 10/1913 | Tesh | 126/42 |
| 1,536,016 | 4/1925 | Kavanagh | 126/42 |
| 2,536,513 | 1/1951 | O'Keefe | 126/42 |
| 3,043,289 | 7/1962 | Fox | 126/42 |
| 3,513,826 | 5/1970 | Hellmuth | 126/42 |
| 3,527,200 | 9/1970 | Baltz et al. | 126/42 |
| 3,789,823 | 2/1974 | Doskocil | 126/42 |
| 4,134,386 | 1/1979 | Miguel | 126/42 |
| 4,527,540 | 7/1985 | Ryan | 126/42 |

FOREIGN PATENT DOCUMENTS

| | | | |
|---|---|---|---|
| 942382 | 11/1963 | United Kingdom | 126/42 |

*Primary Examiner*—James C. Yeung

*Attorney, Agent, or Firm*—John F. McClellan, Sr.

[57] ABSTRACT

A stove guard prevents small children from operating front-mounted controls of a conventional kitchen stove having an open door hinged at the bottom. The stove guard has a front panel portion for extending at a vertically outward angle across the front of a stove. The front panel portion is integral along a transverse lower portion with a horizontal panel portion that projects rearwardly from the transverse lower portion as a shielding bottom and a mount for the stove guard when a rear portion of the rearward projection is clasped between an oven wall and top of oven door, on closure of the oven door. First and second trapezoidal-shape end portions integral with the front panel portion and the horizontal panel portion close off access at the ends of the stove guard.

2 Claims, 3 Drawing Figures

STOVE GUARD

FIELD OF THE INVENTION

This invention relates generally to safety devices and particularly to an improved guard for preventing the heating elements of a stove from being turned on by children.

BACKGROUND OF THE INVENTION

U.S. Pat. No. 4,527,540 to K. Ryan and G. Ryan 7-9-85, showed a suction cup mounted guard that covered a stove front and had eight attachment points to be matched as an example;

U.S. Pat. No. 4,134,386 to F. Miguel, 1-16-79, showed a complex guard unit with hinge pin mechanism, lock and other parts and one that would need to be moved out of the way to use the stove controls;

U.S. Pat. No. 3,789,823 to P. A. Doskocil, 2-5-74, showed a cover that required at least one special stove groove for mounting, and that would need to be moved out of the way to reach the stove controls, or would employ access ports in the reach of children;

U.S. Pat. No. 3,527,200 to A. I. Baltz and E. E. Voeke, 9-8-70, showed a fastener-mounted inter-sliding cover mechanism for stove control guarding;

U.S. Pat. No. 3,513,826 to C. F. Hellmuth, 5-26-70, showed a wall for guarding stove burners;

U.S. Pat. No. 3,043,289 to M. Fox, 7-10-62, showed a guard assembled by magnets;

U.S. Pat. No. 1,536,016 to P. Kavanaugh, 4-28-25, showed a guard with openings in the bottom at the stove controls and an upward hook for attachment to an overhang of the stove.

Foreign Pat. (U.K.) No. 942,382 to J. Powdrill, 11-20-63, showed a three-sided guard with lid.

SUMMARY OF THE INVENTION

A principal object of this invention is to provide a stove guard that prevents front-mounted controls for the heating elements of a stove from being turned on by small children, by preventing access to them, while preserving good access by adults.

Further objects are to provide a stove guard as described that continuously provides said access by adults to the controls, that is one-piece, mounts without modification to conventional kitchen stoves, requires no mounting accessories, can be made in widths to fit most if not all stoves, can be made of transparent or of opaque material to suit customer's desires, and that is economical, and in preferred embodiment is particularly heat-resistant.

Yet further objects are to provide a stove guard as described that is safe, simple in construction, strong, and is easy to mount and to dismount and to store.

Still further objects are to provide a stove guard as described that can keep childrens' hands away from pot handles, and that can catch splatters but is easy to clean with soap and water.

In short, a stove guard prevents small children from operating front-mounted controls of a conventional kitchen stove having an oven door hinged at the bottom.

The stove guard has a front panel portion for extending at a vertically outward angle across the front of a stove.

The front panel portion is integral along a transverse lower portion with a horizontal panel portion that projects rearwardly from the transverse lower portion as a shielding bottom and a mount for the stove guard when a rear portion of the rearward projection is clasped between an oven wall and top of oven door, on closure of the oven door. First and second trapezoidal-shape end portions integral with the front panel portion and the horizontal panel portion close off access at the ends of the stove guard.

BRIEF DESCRIPTION OF THE DRAWING FIGURES

DETAILED DESCRIPTION

Figure 1:
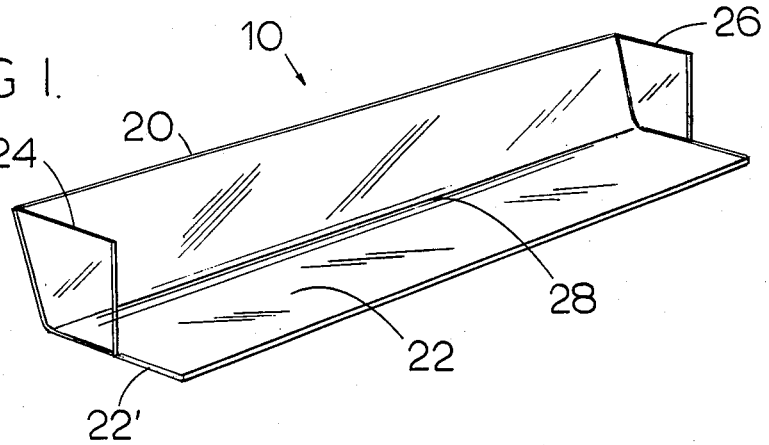
FIG. 1 is a perspective view looking toward the inside of the preferred embodiment.

FIG. 1 shows the invention in embodiment 10 comprising as a unitary structure a stove guard. The stove guard may be of methyl methacrylate sheet, or preferably of a higher-temperature material such as sheet "Kevlar", a polyamide made by E. I. DuPont.

The sheet may be from $\frac{1}{8}$ to $\frac{1}{4}$ inch (3 mm to 6 mm) thick.

When fabricated into the stove guard 10, the sheet defines four preferably flat panel portions; front panel portion 20, horizontal panel portion 22, and end panel portions 24 and 26.

The first two panel portions may be made of a single piece of sheet bent at transverse lower portion 28.

The end panel portions may be cemented or molded integral as uprights joining and covering the respective sides of the first two panel portions, except for the mounting portion 22', and preferably are of trapezoidal shape with one edge vertical and one edge outwardly inclined in an upward direction. The mounting portion is a rearward margin of the part of the horizontal panel portion that projects free of the end panel portions.

The stove guard configuration restricts access except downward access at the top, which only adults normally can employ, and which access is ample for all purposes.

This view shows also how good access for cleaning is provided; even with the sturdy bracing of the end panels 24, 26.

Figure 2:
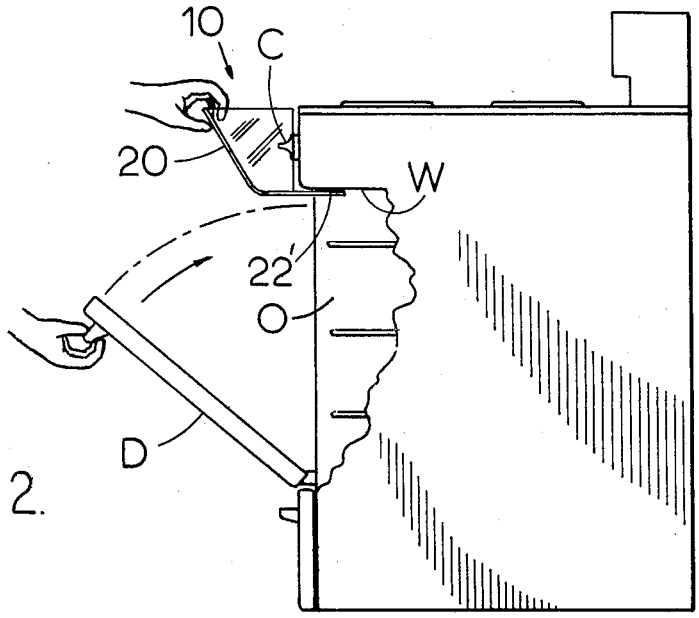
FIG. 2 is a side elevational view of the invention being mounted on a typical kitchen range that has a portion broken away for exposition.

FIG. 2 shows that the embodiment 10 of the invention is very easy and quick to mount to a conventional stove with upward opening oven door D and front mounted controls C above the top wall W of an oven. The embodiment is held by the front panel portion 20 against the stove in position for the oven door D to be closed (arrow) and clamp the rearward projection 22' of the stove guard second panel portion between the oven door D and the top wall W of the oven O, rendering the front mounted controls C inacessible to small children.

Figure 3:
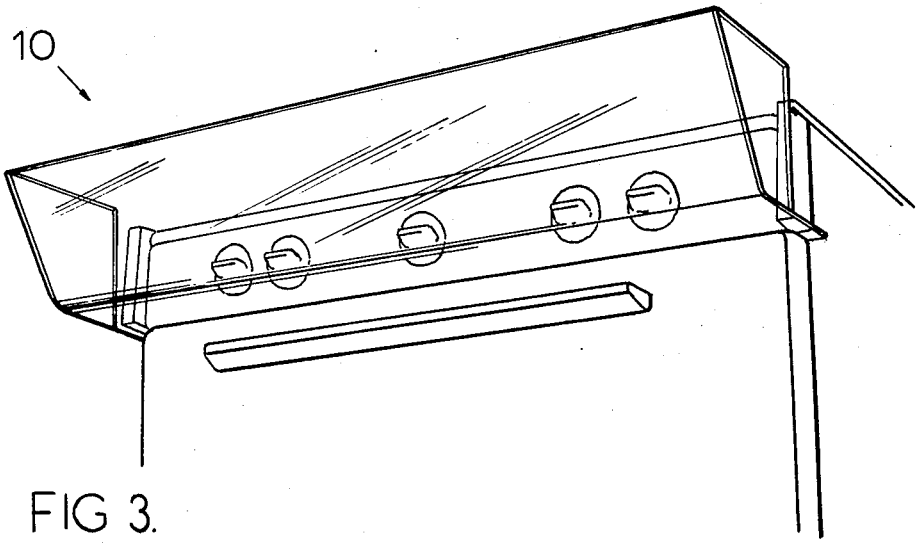
FIG. 3 is a front perspective view of the invention installed on the range.

FIG. 3 shows in a child's eye view how thoroughly the invention in embodiment 10 covers the stove controls C, and also how attractive in general appearance the embodiment is.

Fit of the stove guard is adjustable in-and-out to close gaps at the ends; the bottom is closed at all times.

The width of the stove guard need not be exact, but needs to be only sufficient for each of the end portions to fit outside the group of stove controls, if the ends fit against the stove front, and is not critical for that reason.

In a tested embodiment the dimensions were:

width over-all 31 inches (68 cm);

shorter dimension of front panel portion and of horizontal panel portion, 6 inches (15 cm) each;

rearward projection of horizontal panel portion beyond the end panel portions 3 inches (7.5 cm);

angle between front panel portion and horizontal panel portion about fifty degrees.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. A stove guard (10) for preventing access by small children to controls of a conventional stove, the conventional stove being of the type having an upwardly closing oven door (D), an oven (O) with a top wall (W) and front mounted controls (C) above the top wall of the oven (O), while preserving good access for operation of said front mounted controls (C) by adults, comprising: said stove guard comprising: a front panel portion (20) proportioned for covering the front of said front mounted controls (C), said front panel portion (20) sloping upwardly and outwardly toward the front and leaving access from above to said front mounted controls (C); said front panel portion (20) having a transverse lower portion (28), a horizontal panel portion (22) extending rearwardly from the transverse lower portion (28) at an open angle to the front panel portion (20); a rearward portion (22') of the horizontal panel portion (22) in position permitting clamping the rearward portion (22') between a said top wall (W) of an oven (O) and oven door (D) on closure of said oven door (D); the front panel portion (20) and the horizontal panel portion (27) having respective sides, first and second end panels (24,26) joining the respective sides of the front panel portion (20) and the horizontal panel portion (22), and closing off access at said sides.

2. A stove guard as recited in claim 1, said stove guard being unitary, of transparent material, said first and second end portions being trapezoidal in shape, and said open angle being substantially fifty degrees.

* * * * *